United States Patent [19]

Cree

[11] Patent Number: 4,726,516

[45] Date of Patent: Feb. 23, 1988

[54] FOLDABLE RAMP

[76] Inventor: Ian C. Cree, P.O. Box 2108, Rancho Santa Fe, Calif. 92067

[21] Appl. No.: 34,536

[22] Filed: Apr. 6, 1987

Related U.S. Application Data

[63] Continuation of Ser. No. 789,685, Oct. 21, 1987, abandoned.

[51] Int. Cl.[4] ..... E01B 23/00

[52] U.S. Cl. ..... 238/10 R; 14/69.5

[58] Field of Search ..... 14/69.5, 71.1; 238/10 R; 254/88; 414/396, 401, 537, 538, 584, 921

[56] References Cited

U.S. PATENT DOCUMENTS

| | | | |
|---|---|---|---|
| 484,086 | 10/1892 | Cassidy | 14/71.1 |
| 963,918 | 7/1910 | Miller | 14/69.5 |
| 1,348,142 | 7/1920 | Jaeger | 14/69.5 X |
| 1,558,581 | 10/1925 | Bloom | 14/71.1 X |
| 2,076,069 | 4/1937 | Davis | 254/88 |
| 3,074,241 | 1/1963 | Cahill et al. | 14/71.1 X |
| 3,936,898 | 2/1976 | Poe | 14/69.5 |
| 4,013,268 | 3/1977 | Williams | 254/88 |
| 4,107,932 | 8/1978 | Cantrell | 14/69.5 X |
| 4,528,711 | 7/1985 | Packer | 14/69.5 X |

*Primary Examiner*—Robert B. Reeves
*Assistant Examiner*—Scott H. Werny
*Attorney, Agent, or Firm*—Charmasson & Holz

[57] ABSTRACT

A pair of coplanar, telescopic tracks are held in a spaced-apart and generally parallel relationship by a plurality of crossties. The crossties may also be telescopic to vary the space between the tracks according to use. At one end the tracks can be elevated by length-adjustable props or variable trusses. Each track comprises at least two segments, a first segment adapted to be slidably disposed in a channel of the second segment. The segments can be channel bars. A detent is used to temporarily hold the tracks at any of a plurality of telescoped lengths. A variable truss comprises a pair of divergent struts with a variable length member subtending the angle between the struts. This device is especially useful as a variable ramp for wheelchairs when it is made from relatively lightweight material such as aluminum.

2 Claims, 17 Drawing Figures

FOLDABLE RAMP

This is a continuation of application Ser. No. 789,685 filed Oct. 21, 1987, now abandoned.

BACKGROUND OF THE INVENTION

This invention relates to ramps in general to variable and transportable ramps and more specifically to collapsible ramps for wheeled objects.

Transportable and collapsible ramps for wheeled objects such as wheelchairs are known in the art. U.S. Pat. No. 3,818,528 by Petersen shows a pair of tracks laterally hinged to and spaced apart by a center member, the tracks being foldable in upon the center member and the combination being longitudinally foldable. The track length and vertical rise are not adjustable.

U.S. Pat. No. 4,084,713 by Rohrs et al. shows a wheelchair ramp hingably mounted on the floor of an automobile. It comprises a pair of fixedly space tracks longitudinally foldable. U.S. Pat. No. 3,176,334 by Lovdahl shows a very similar ramp. Likewise U.S. Pat. No. 4,127,201 by Baumann shows a collapsible ramp comprised of a pair of longitudinal supports secured to and supported by a vehicle for the purpose of loading and unloading wheeled objects. In all the above cases the track lengths not adjustable and the tracks themselves are not self-surpporting.

U.S. Pat. Nos. 3,315,292 by Collins and 3,936,898 by Poe both show hinged together plates of rectangular configuration with vertical members for a self-supported rise. They are not longitudinally nor laterally adjustable in dimension.

This invention addresses in particular the problem of providing a lightweight ramp for persons confined to a wheelchair which is adaptable to a wide variety of ramping requirements. For example, this invention can be used to ramp a wheelchair in or out of a vehicle, up or down a street curb, and up or down a small flight of stairs. It is adjustable in length and width, it is self-supporting, and it is adjustably variable in its vertical rise. Furthermore it is collapsible and can be easily carried by a wheelchair.

Other advantages and attributes of this invention will be readily discernible upon a reading of the text hereinafter.

SUMMARY OF THE INVENTION

The principal and secondary objects of the invention are:

To provide a portable, lightweight ramp for persons in wheelchairs;

Other objects of this invention will be readily apparent upon a reading of the text hereinafter.

These and other objects are achieved by a ramp comprising a ramp frame and a variable elevation means proximate an end of the ramp frame for elevating said end above the opposite end of the ramp frame. A ramp frame comprises a pair of coplanar, telescopic tracks held in a spaced-apart and generally parallel relationship by a plurality of crossties. The crossties themselves can also be telescopic. Each track comprises at least two segments, a first segment adapted to be slidably disposed in a channel of the second segment. The segments can be channel bars, and hook-like flanges along the margins of the second segment hook the margins of the first segment. A detent is used to temporarily hold each track at any of a plurality of telescoped lengths. Optionally, a telescopic underframe serves that purpose. The elevation means can be a length-adjustable prop or a variable truss means. A variable truss can comprise a pair of divergent struts with a variable length member subtending the angle between the struts. The variable length member can be a notched rack or a holed bracket. The ramp is collapsible in that all telescopic members can be telescoped into their minimum lengths to facilitate storage and/or transportation of the ramp.

DESCRIPTION OF THE PREFERRED EMBODIMENT

Figure 1:
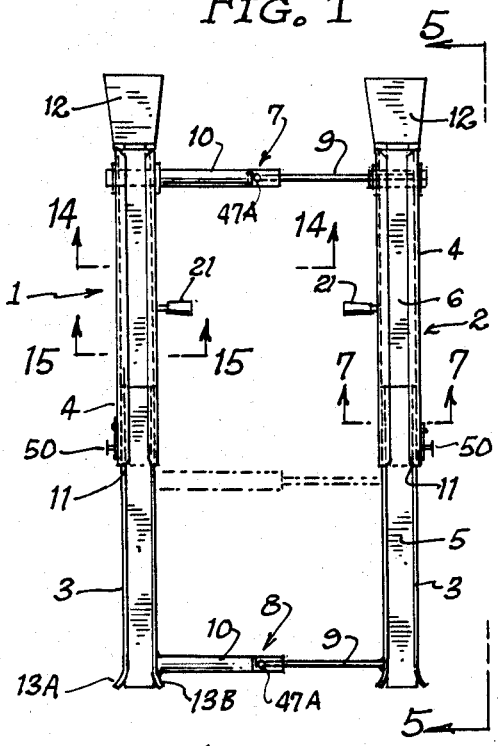
FIG. 1 is a plan view of a first embodiment of this invention.
Figure 7:
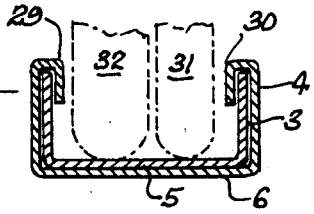
FIG. 7 is a sectional view taken along line 7—7 of FIG. 1.

Referring to FIGS. 1 and 7, a pair of coplanar, spaced-apart, telescopic tracks, generally designated 1 and 2, are shown to each comprise a first channel bar 3 adapted to telescope in a second channel bar 4, each channel bar having a U-like cross section with two narrower sides at right angles to a broader base, 5 and 6. The tracks, 1 and 2, are held in a variably spaced-apart relationship by a plurality of telescopic crosstie members, preferably two which are generally designated 7 and 8. Each crosstie member comprises a rod 9 adapted to telescope into a tube 10. The crosstie member shown in phantom represents a situation where the first channel bars 3 are fully telescoped into the second channel bars 4. The tracks and the crossties together comprise a ramp frame.

Referring again to FIG. 1, each of the second channel bars 4 has, at an end remote from a juncture 11 of the first and second bars, a toe plate 12 which is dovetail shaped and hinged to the base 6 of the channel. The toe plates facilitate entry onto the tracks. Each of the first channel bars 3 has, at an end remote from said juncture, outwardly flared sides 13A and 13B. The flared sides act to funnel wheels into the tracks.

Figure 2:
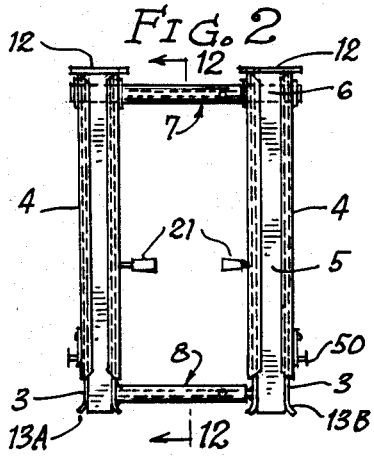
FIG. 2 is a plan view of the embodiment of FIG. 1 in collapsed configuration.

Referring to FIG. 2, the ramp of FIG. 1 is seen to be in a collapsed configuration, that is, the tracks are telescoped together and the crossties are telescoped together. Also, the toe plates are folded to their fullest extent toward the tracks.

Figure 3:
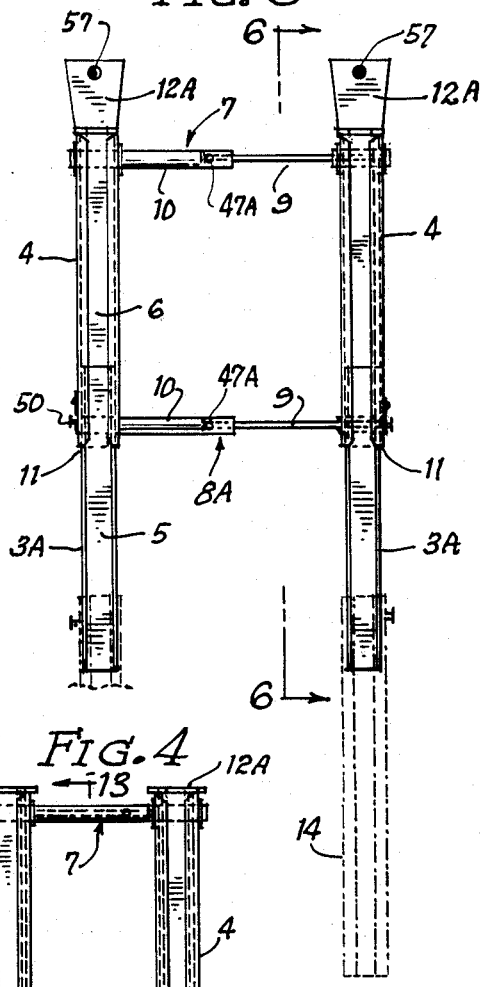
FIG. 3 is a plan view of a second embodiment of this invention.

Referring to FIG. 3, a ramp similar to that of FIG. 1 is shown but with a different crosstie arrangement and without the outwadly flared first channel sides. FIG. 1 shows a first crosstie 7 being affixed to the second channel bars proximate the toe plates, and a second crosstie 8 being affixed to the first channel bars proximate the flared sides. FIG. 3 shows a first crosstie 7 similarly affixed to second channel bars 4 proximate tow plates 12A, but a second crosstie 8A is also affixed to the second channel bars, proximate the juncture 11 of the second channel bars 4 and unflared first channel bars 3A, in place of having the second crosstie affixed as shown in FIG. 1. This permits a pair of third channel bars 14 (one shown in phantom) to be joined to the free ends of the first channel bars 3A in order to extend the effective ramp length. The third channel bars preferably have a same cross section as the second bars.

Figure 4:
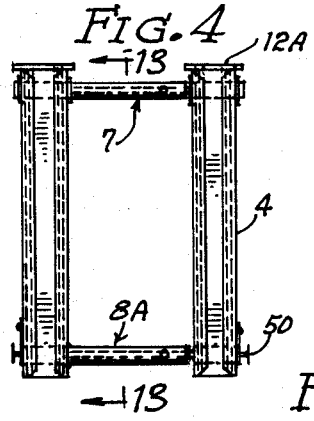
FIG. 4 is a plan view of the embodiment of FIG. 3 in a collapsed configuration.

Referring to FIG. 4, the ramp of FIG. 3 is shown in a collapsed configuration.

Figure 5:
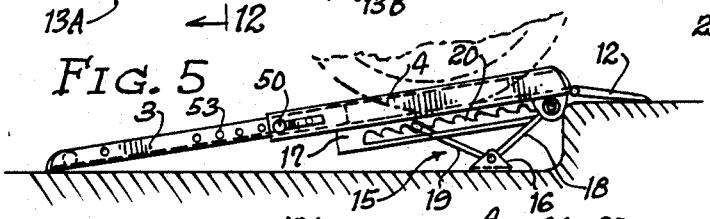
FIG. 5 is a side view of the embodiment of FIG. 1.

A variable elevation means is affixed to the ramp frame proximate the end with the toe plates. This is the elevatable end of the ramp frame. In FIG. 5 the elevation means is seen to comprise a pair of variable trusses 15 (only one shown), one affixed to and supporting the elevatable end of each track. Each truss is in the form of an inverted triangle, the apex of which is pivotally engaged with a foot piece 16. The foot piece supports the truss which supports the track.

Referring again to FIG. 5, each truss comprises three legs, a first leg being formed by a notched rack 17 affixed to the underside of its corresponding track. The rack runs longitudinally with the track and forms one leg of the triangular truss, the base of the inverted triangle. A second leg is formed by a first strut 18 pivotally engaged at one end with the foot piece and at the other end with the rack at a rack end nearest the toe plate. A third leg is formed by a second strut 19 pivotally engaged at one end with the foot piece and at the other end releasably engaged with one of a series of rack notches 20. In effect, the intersection of the struts forms the apex of the truss triangle, and the rack is a variable length side of the triangle which subtends the apex angle or angle of strut divergence. In operation, as the third leg (second strut) engages notches increasingly distant from the elevatable end, the struts become increasingly divergent, and since the struts have fixed lengths, the elevation decreases and vice versa. Preferably the struts are spring biased to be maximally divergent so that the second strut is continually urged to be seated in any notch with which it is engaged. Each second strut is manipulated by a handle 21 affixed normal thereto. A suitable downward force on the handle will unseat the strut from a notch thereby releasing it.

Figure 6:
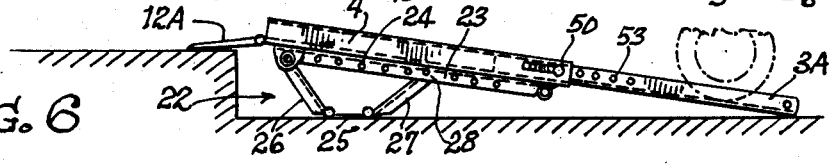
FIG. 6 is a side view of the embodiment of FIG. 3.

Referring to FIG. 6, a different type of variable truss 22 is shown. This truss is in the form of an inverted trapezium: four nonparallel legs. A first leg is formed by an elongated bracket 23 affixed to the underside of its corresponding track, proximate the elevatable end, and running with the track. The bracket defines a row of uniformly spaced pin holes 24, the row being parallel with the track. A second and opposite leg is a foot piece 25. The other two legs are struts: a first strut 26 pivotally engaged at one end with the foot piece and at the other end with the bracket at a bracket end nearest the toe plate; a second strut 27 pivotally engaged at one end with the foot piece and at the other end releasably engaged by a pin means 28 with any one of the bracket pin holes. In effect the bracket is a variable side of the truss trapezium which once again subtends an angle of strut divergence. In operation, as the second strut pin engages pin holes increasingly distant from the elevatable end, the struts become increasingly divergent and, as before, the elevation decreases, and vice versa.

FIG. 7 shows the margins of the sides of the second channel bar 4 each forming a flange, 29 and 30, with a hook-like cross section which hooks the margin of an adjacent side of the first channel bar 3. The flanges serve to keep the first channel bar slidably disposed in the channel of the second channel bar. The inner 31 and outer 32 wheels of a wheel chair are shown in phantom. This illustrates the relative sizes of the channel bars of a ramp, according to this specification, which is adapted to be used as a wheelchair ramp. It also illustrates that the sides of the channel bars, besides making the bars more rigid, act as curbs to confine the wheels to the tracks.

Figure 8:
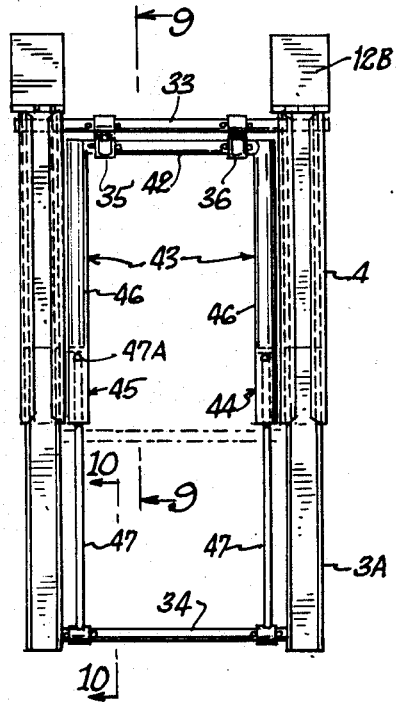
FIG. 8 is a plan view of a third embodiment of this invention.

Referring to FIG. 8, a third variation of the ramp is shown. It comprises a pair of coplanar, spaced-apart, telescopic tracks and an elevation means to elevate an end of the ramp. Each track is identical to the tracks of FIG. 3, but the crossties and the elevation means are different. The crossties are a plurality of tie rods, preferably two: one 33 affixed to the tracks at the elevatable end of the ramp; a second 34 affixed to the tracks at or proximate an opposite end of the ramp. The phantom tie rod shown represents a situation where the first channel bars 3A are fully telescoped into the second channel bars 4. The toe plates 12B are shown to be rectangular rather than dove tailed.

Figure 9:
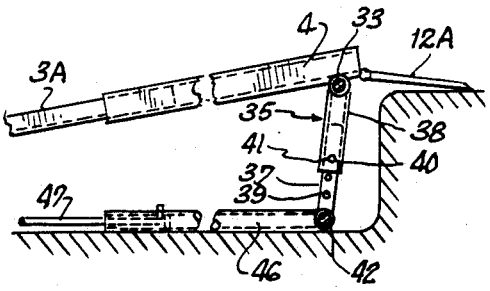
FIG. 9 is a partial section taken along line 9—9 of FIG. 8.
Figure 10:
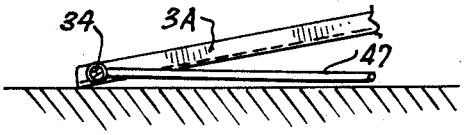
FIG. 10 is a partial section taken along line 10—10 of FIG. 8.

Referring to FIGS. 8, 9 and 10, an elevation means is seen to comprise two telescopic props, 35 and 36. Each prop is length adjustable by means of a rod 37 adapted to telescope in a tube 38. Each prop rod defines a plurality of uniform, uniformaly and longitudinally spaced pin holes 39, and each prop tube defines a single matching hole 40. A prop pin means 41 is inserted through the tube hole into one of the rod holes to set the elevation of the ramp end. The prop tubes are pivotally engaged with the crosstie 39 at the elevatable end. The prop rods are pivotally engaged with a cross piece 42 of a U-like telescopic frame 43. The cross piece ties together two telescopic legs 44 and 45, each telescopic leg comprising a frame tube 46 in which telescopes a frame rod 47. The frame rods are pivotally engaged with the crosstie 34 at the track end remote from the elevatable end.

Figure 11:
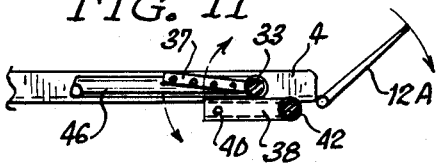
FIG. 11 is a partial side view of the embodiment of FIG. 8 in a collapsed configuration.

Referring to FIG. 11, it can be seen that the props 35 can be disassembled, that is, the rods 37 removed from the tubes 38, and the telescopic frame 43 can be rotated about the crosstie 34 to be coplanar with the tracks, thus presenting a flat profile. Also, the rods 37, the tubes 38 and the toe plates 12B can be rotated to a more compact disposition.

Figure 12:
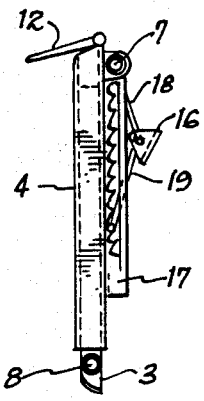
FIG. 12 is a side view of the embodiment of FIG. 1 in a collapsed configuration.
Figure 13:
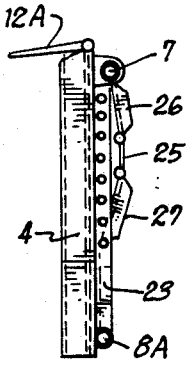
FIG. 13 is a side view of the embodiment of FIG. 3 in a collapsed configuration.

FIGS. 12 and 13 show the elevation means of FIGS. 5 and 6, respectively, in their most compact dispositions.

Figure 14:
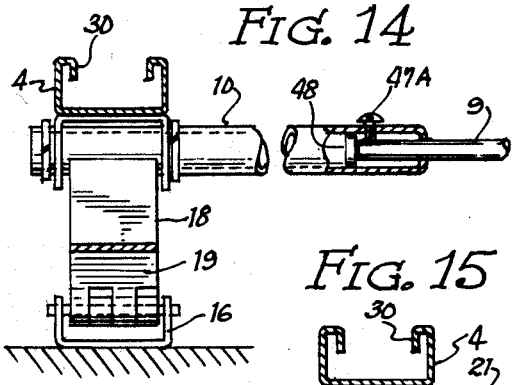
FIG. 14 is a partial section taken along line 14—14 of FIG. 1.

FIG. 14 shows in greater detail how the crosstie rods 9 telescope in the crosstie tubes 10. It can also be seen that a stop or screw 47A is used to bear against the rod 9 and hold it in place until the stop is released. The rod also has a head 48 which prevents it from being completely removed from the tube. Since the stop 47A can bear against the rod at any point within the range of rod movement in the tube, the crossties are infinitely adjustable within said range.

Figure 15:
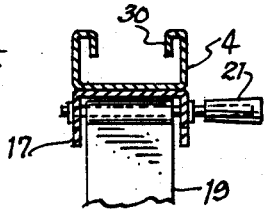
FIG. 15 is a partial section taken along line 15—15 of FIG. 1.

FIG. 15 presents in greater detail the handle 21 used to manipulate the second strut 19 along the rack 17 of the ramp of FIG. 1.

Figure 16:
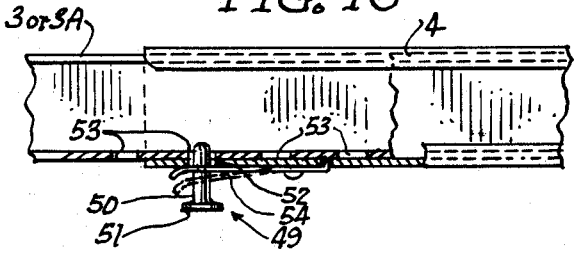
FIG. 16 is a partial section detailing a detent of a track.

Referring to FIG. 16, a detent means 49 is shown. The detent means is used to releasably lock a telescoping first channel bar in place in a second channel bar. The detent comprises a pin 50 with a graspable head 51 which pin is inserted through a hole 52 defined by a second channel bar 4 or the third channel bar 14 into one of a series of pin holes 53 defined by a first channel bar, 3 or 3A, the pin 50 being affixed to a leaf spring 54 which is affixed to the second or third channel bar. The leaf spring urges the pin to remain in the channel bar holes. To slide the first channel bar to a new position, the head 51 of the pin is grasped and pulled, in opposition to the leaf spring, out of its current first channel pin hole and held so until the first channel bar has been repositioned such that a new first channel bar hole is aligned with the second channel bar hole. The pin is then released to hold the second bar in place.

Figure 17:
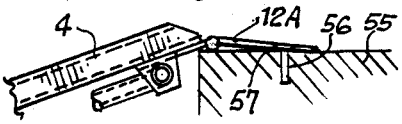
FIG. 17 is a partial side view of the embodiment of FIG. 3 detailing features of the toe plate.

Referring to FIG. 17, a toe plate 12A of the kind shown in FIG. 3 is temporarily anchored to a platform 55 by means of an anchor pin 56 projecting into the platform through hole 57 defined by the toe plate. The anchor pin prevents the ramp from moving away from the platform.

The foregoing was given for illustrative purposes only and no unnecessary limitations in the following claims should be derived therefrom.

I claim:

1. A ramp frame comprising:

a frame including a pair of coplanar, telescopic tracks held in a spaced-apart and generally parallel relationship by a plurality of crossties;

a pair of length-adjustable prop means disposed below an elevatable end of the ramp frame for elevating said end above the opposite end of the ramp frame;

means for temporarily holding the tracks at any of a plurality of telescoped lengths; and a telescopic under frame pivotally affixed at one end to the prop means, and pivotally affixed at one opposite end to the ramp frame at a ramp frame end remote from the prop means, and means for temporarily holding the underframe at any of a plurality of telescoped lengths.

2. A ramp comprising:

a frame including a pair of coplanar telescopic tracks held in a variably spaced-apart relationship by a plurality of telescopic crosstie members;

a pair of length-adjustable prop means disposed below an elevatable end of the ramp frame for elevating said end above the opposite end of the frame;

means for temporarily holding the tracks at any of a plurality of telescoped lengths;

means for temporarily holding the crossties at any of a plurality of telescoped lengths; and a telescopic underframe pivotally affixed at one end to the prop means, and pivotally affixed at an opposite end to the ramp frame at a ramp frame end remote from the prop means, and means for temporarily holding the underframe at any of a plurality of telescoped lengths.

* * * * *